US008155563B2

(12) United States Patent
Ishihara

(10) Patent No.: US 8,155,563 B2
(45) Date of Patent: Apr. 10, 2012

(54) IMAGE FORMING APPARATUS HAVING PRINT ENGINE WHICH PRINTS POSITION-CODING PATTERN WITH SPECIFIC DEVELOPING MATERIAL

(75) Inventor: Toru Ishihara, Tokyo (JP)

(73) Assignee: Oki Data Corporation, Tokyo (JP)

( * ) Notice: Subject to any disclaimer, the term of this patent is extended or adjusted under 35 U.S.C. 154(b) by 374 days.

(21) Appl. No.: 12/585,751

(22) Filed: Sep. 24, 2009

(65) Prior Publication Data

US 2010/0074653 A1 Mar. 25, 2010

(30) Foreign Application Priority Data

Sep. 25, 2008 (JP) ..... 2008-245243

(51) Int. Cl.
*G03G 15/01* (2006.01)

(52) U.S. Cl. ..... 399/223

(58) Field of Classification Search ..... 399/54, 399/223, 228; 178/18.01; 382/188, 189; 430/42.1, 45.1

See application file for complete search history.

(56) References Cited

U.S. PATENT DOCUMENTS

| | | | | |
|---|---|---|---|---|
| 4,992,831 | A * | 2/1991 | Kunishi | 399/223 |
| 5,184,183 | A * | 2/1993 | Karidis et al. | 399/231 |
| 5,659,864 | A * | 8/1997 | Oka et al. | 399/321 |
| 5,869,213 | A * | 2/1999 | Iwata et al. | 430/45.3 |
| 6,854,821 | B2 * | 2/2005 | Ericson et al. | 347/14 |
| 7,327,973 | B2 * | 2/2008 | Yamada et al. | 399/226 |
| 7,654,463 | B2 * | 2/2010 | Mitamura | 235/472.03 |
| 8,029,084 | B2 * | 10/2011 | Uchiyama et al. | 347/19 |

FOREIGN PATENT DOCUMENTS

| | | | |
|---|---|---|---|
| JP | 11-218965 | | 8/1999 |
| JP | 2002-240387 | | 8/2002 |
| JP | 2003-149994 | | 5/2003 |
| JP | 2004-341831 | A | 12/2004 |
| JP | 3706385 | | 8/2005 |
| JP | 2006-267511 | | 10/2006 |
| JP | 2007-279961 | | 10/2007 |
| JP | 2008-107576 | | 5/2008 |
| JP | 2009099129 | A * | 5/2009 |
| WO | WO-2004/084125 | A1 | 9/2004 |

* cited by examiner

*Primary Examiner* — Robert Beatty
(74) *Attorney, Agent, or Firm* — Rabin & Berdo, P.C.

(57) ABSTRACT

An image forming apparatus is capable of printing a position-coding pattern. A first print engine prints a position-coding pattern and holds a first developer material therein. A plurality of second print engines each print a corresponding image in accordance with print data, the image being different from the position-coding pattern, each of the second print engines holding a corresponding second developer material therein. The first developer material is charged to a first average amount of charge and has a first distribution of amount of charge. The second developer material is charged to a second average amount of charge and has a second distribution of amount of charge, such that the first average amount of charge is larger than the second average amount of charge, and that the first distribution of amount of charge has a smaller standard deviation than the second distribution of amount of charge.

15 Claims, 5 Drawing Sheets

X10 MAGNIFICATION

X10 MAGNIFICATION

IMAGE FORMING APPARATUS HAVING PRINT ENGINE WHICH PRINTS POSITION-CODING PATTERN WITH SPECIFIC DEVELOPING MATERIAL

BACKGROUND OF THE INVENTION

1. Field of the Invention

The present invention relates to an image forming apparatus such as a copying machine, a facsimile machine, or a printer.

2. Description of the Related Art

Digital pens are capable of digitizing what is written in ink on a piece of paper, and capable of allowing such a hand written information on a display unit. One such digital pen is the Anoto pen capable of recognizing the Anoto pattern. The Anoto pattern is a dot pattern that contains dots formed near the intersections of grid lines. The grids are spaced apart by about 0.3 mm. As the Anoto pen moves on the piece of the dot pattern, the positions of the pen tip are identified.

In order for a digital pen to identify the location of its pen tip on a sheet of paper, the dots must be printed on the sheet of paper very accurately. However, some image forming apparatuses are unable to print the dots with high accuracy. In other words, a dot pattern for use with the digital pen is difficult to accurately form.

SUMMARY OF THE INVENTION

The present invention was made in view of the aforementioned drawbacks.

An object of the invention is to improve the reproducibility of a position-coding pattern.

An object of the invention is to provide an image forming apparatus capable of reliably printing a position-coding pattern.

An image forming apparatus is capable of, printing a position-coding pattern. A first print engine prints a position-coding pattern and holds a first developer material therein. A plurality of second print engines each print a corresponding image in accordance with print data, the image being different from the position-coding pattern. Each of the second print engines holds a corresponding second developer material therein. The first developer material is charged to a first average amount of charge and has a first distribution of amount of charge. The second developer material is charged to a second average amount of charge and has a second distribution of amount of charge, such that the first average amount of charge is larger than the second average amount of charge, and that the first distribution of amount of charge has a smaller standard deviation than the second distribution of amount of charge.

Further scope of applicability of the present invention will become apparent from the detailed description given hereinafter. However, it should be understood that the detailed description and specific examples, while indicating preferred embodiments of the invention, are given by way of illustration only, since various changes and modifications within the scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

Embodiments of the present invention will be described in detail with reference to the accompanying drawings.

First Embodiment

{Configuration}

Figure 1:
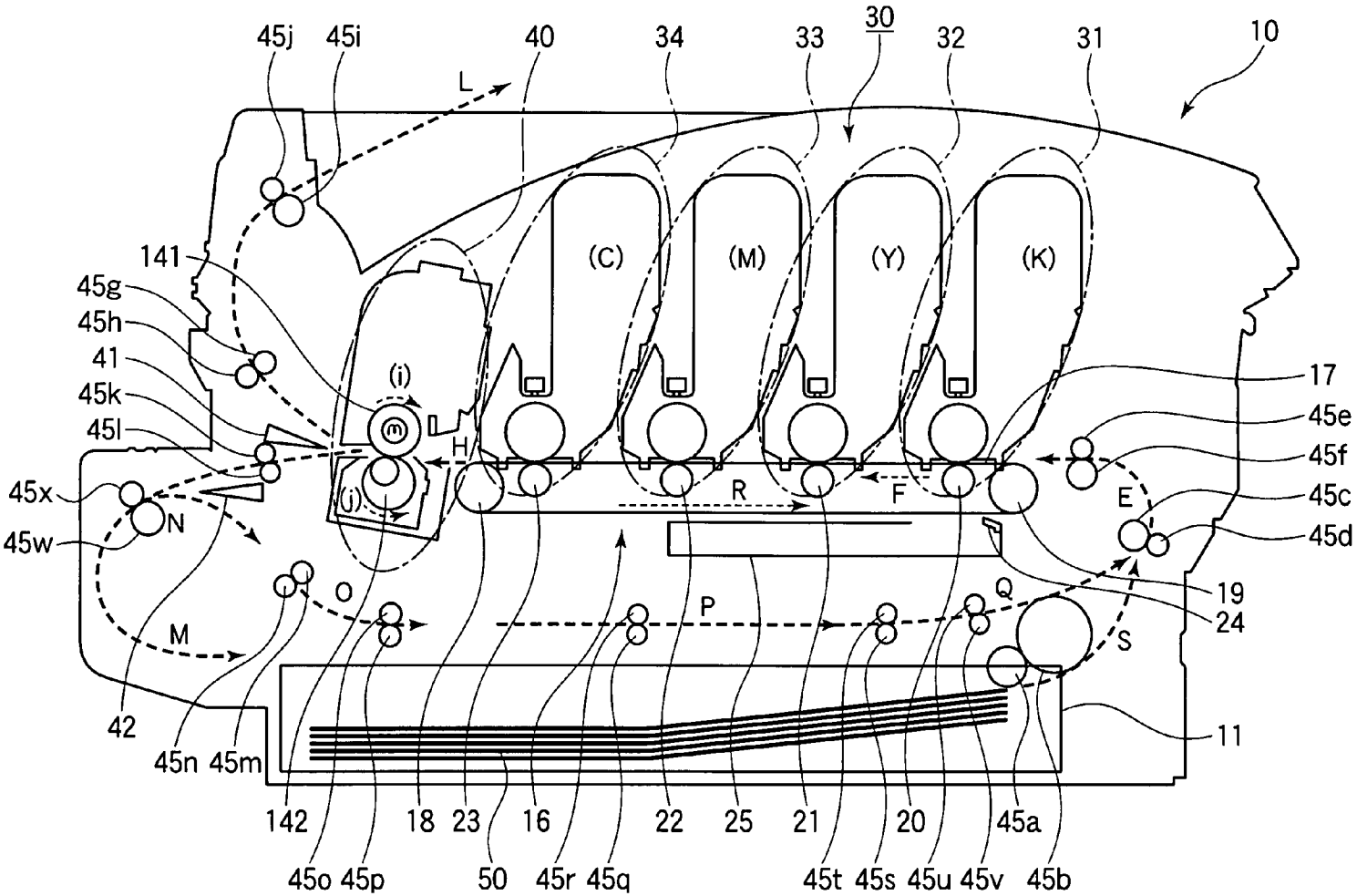
FIG. 1 illustrates the configuration of a printer of a first embodiment.

FIG. 1 illustrates the configuration of an image processing apparatus or a printer 10 of a first embodiment. The printer 10 is a direct transfer image forming apparatus in which an image is transferred directly from a photoconductive drum 101 onto a print medium or recording paper. The printer 10 includes a paper cassette 11, a print engine unit 30, a fixing unit 40, transport rollers 45*a*-45*x*, and fingers 41 and 42 as an inverter selector.

The paper cassette 11 holds a stack of recording paper 50 therein, and is attached to a lower portion of the printer 10. The transport rollers 45*a* and 45*b* cooperate with each other to feed the top sheet of the stack of recording paper 50 into a transport path in a direction shown by arrow S. When the recording paper 50 is transported in a direction shown by arrow E, the transport rollers 45*e* and 45*f* cooperate with each other to correct skew of the recording paper 50 before the recording paper 50 is fed into the print engine unit 30.

The print engine unit 30 includes a first print engine for black (K) image or a print engine 31, second print engines for yellow (Y), magenta (M), and cyan (C) images, respectively, or print engines 32-34 attached to the printer 10. The four print engines 31-34 are quickly releasable. The print engines 31-34 are aligned in this order from upstream to downstream along the transport path. The four print engines 31-34 may be substantially identical, and differ only in the color of developer material or toner. The print engine unit 30 also includes a transfer unit 16 that transfers toner images of the respective colors onto the recording paper 50 by an electrostatic attractive force (Coulomb force).

The transfer unit 16 includes a transfer belt 17 that transports the recording paper 50 while attracting the recording paper 50 thereto by the electrostatic force. The transfer belt 17 is disposed about a drive roller 18 and a tension roller 19. The drive roller 18 drives the transfer belt 17 to run, and the tension roller 19 cooperates with the drive roller 18 to maintain the transfer belt 17 in tension. Transfer rollers 20-23 are in pressure contact with photoconductive drums of the respective print engines 31-34 with the transfer belt 17 sandwiched between the transfer rollers 20-23 and the photoconductive drums. High voltages are applied to the transfer rollers 20-23 during transfer of toner images. A cleaning blade 24 scrapes residual toner from the transfer belt 17 as the transfer belt 17 runs. The scraped residual toner is collected into a waste developer tank 25.

{Print Engine}

Each of the print engines 31-34 may be substantially identical; for simplicity only the operation of the black print engine 31 for forming black images will be described, it being understood that the other print engines 32-34 may work in a similar fashion.

Figure 2:
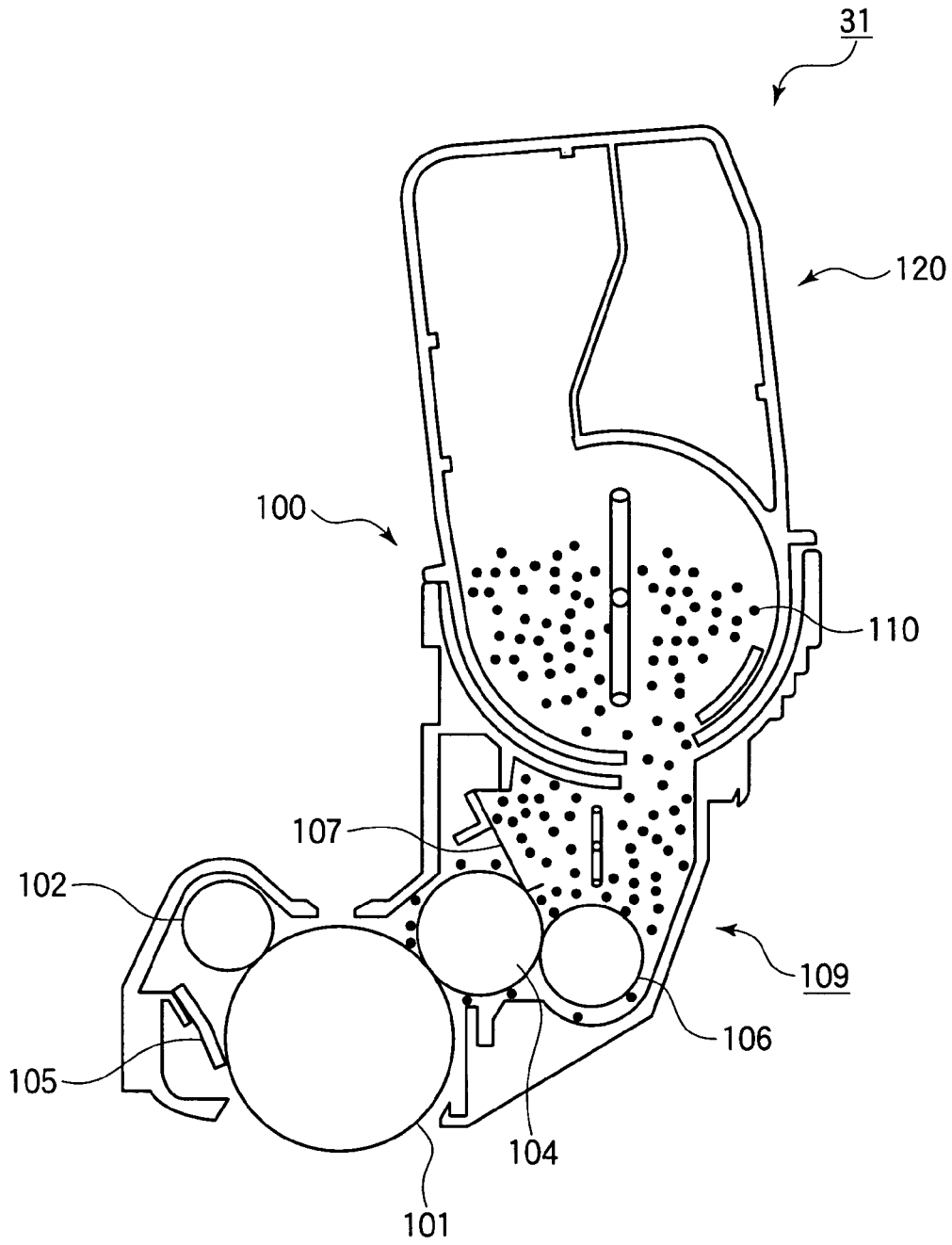
FIG. 2 illustrates a pertinent portion of a print engine of the printer.

FIG. 2 illustrates a pertinent portion of the print engine 31. Referring to FIG. 2, the print engine 31 includes a developing unit 109, an image bearing body or a photoconductive drum 101, a charging device or a charging roller 102, and a cleaning blade 105. The developing unit 109 includes a developing mechanism 100 that includes a developer material bearing body or a developing roller 104, a supplying roller 106, and a developing bade 107. The developing unit 109 also includes a developer material holder 120. The developer material holder 120 of the print engine 31 holds a first developer material or a pattern-printing toner. The developer material holders 120 of the print engines 32-34 hold second developer materials or image printing toners for printing a yellow toner image, a magenta toner image, and a cyan toner image, respectively. The print engine 31 is attached to predetermined portion of the print engine unit 30, and the developer material holder 120 is attached to the developing mechanism 100. The print engine 31 and developer material holder 12 are quickly releasable.

Figure 3:
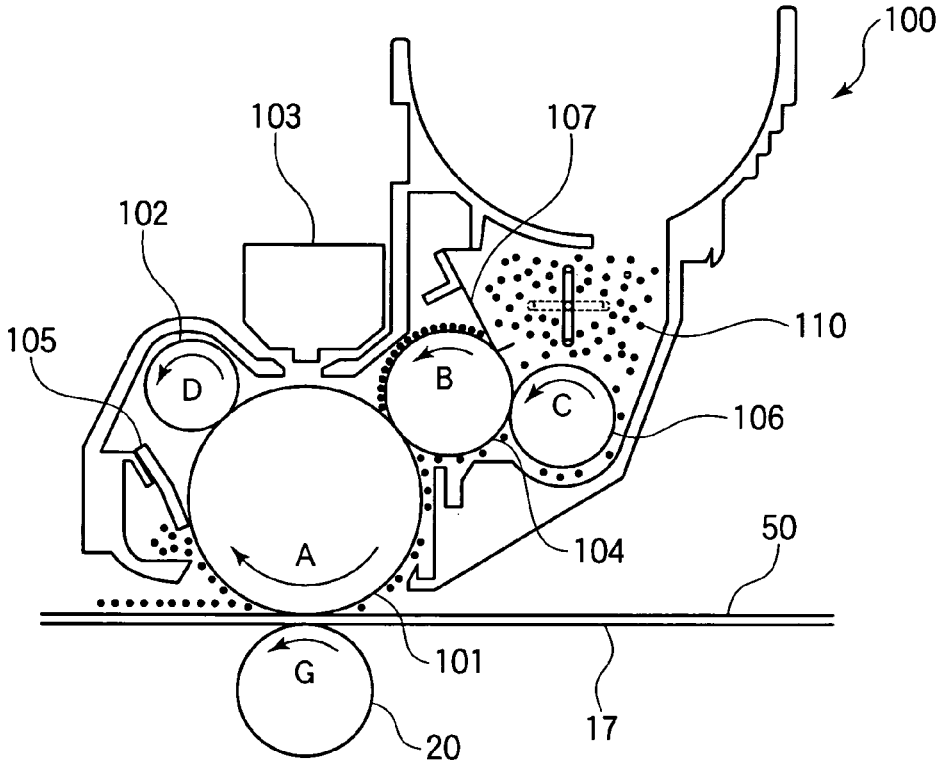
FIG. 3 illustrates a pertinent portion of the print engine except for a developer material holder.

FIG. 3 illustrates a pertinent portion of the print engine 31 except for the developer material holder 120. The photoconductive drum 101 includes an electrically conductive supporting body covered with a photoconductive insulating layer. The electrically conductive supporting body is a cylinder formed of aluminum. The photoconductive drum 101 is an organic photoconductive body that includes a charge generation layer that covers the conductive supporting body and a charge transport layer laminated on the charge generation layer. The charging roller 102 includes a metal shaft covered with photoconductive epichlorohydrin rubber, and rotates in contact with the circumferential surface of the photoconductive drum 101. An exposing device or a light emitting diode (LED) head 103 includes, for example, LEDs and a lens array, and is disposed at a position where light emitted from the LEDs illuminates the charged circumferential surface of the photoconductive drum 101 to form an electrostatic latent image.

The developing roller 104 rotates in contact with the circumferential surface of the photoconductive drum 101. The developing roller 104 includes a metal shaft of, for example, stainless steel covered with urethane rubber in which carbon black is dispersed. The developing blade 107 is formed of stainless steel and is in pressure contact with the circumferential surface of the developing roller 104. The cleaning blade 105 or a developer material collecting device is formed of urethane, and is in pressure contact with the circumferential surface of the photoconductive drum 101.

Referring to FIG. 3, the photoconductive drum 101 rotates at a predetermined speed in a direction shown by arrow A. The charging roller 102 rotates in contact with the photoconductive drum 101 in a direction shown by arrow D. The charging roller 102 receives a charging bias of −1000 V from a charging roller power supply (not shown), thereby uniformly charging the circumferential surface of the photoconductive drum 101. The LED head 103 illuminates the uniformly charged circumferential surface of the photoconductive drum 101 in accordance with an image signal. The charges in illuminated areas are dissipated to form an electrostatic latent image as a whole. The potential at the illuminated areas is about −50 V, while the potential at the non-illuminated areas is about −500 V.

The developing roller 104 is in intimate contact with the photoconductive drum 101, and receives a developing bias of −200 V from a developing roller power supply (not shown). The developing roller 104 attracts toner 110 delivered thereto by the supplying roller 106 to which a supplying bias of −300 V is applied, and rotates in a direction shown by arrow B to supply the toner 110 to the developing roller 104. The developing blade 107 is in pressure contact with the developing roller 104, and forms a thin layer of the toner 110 having a uniform thickness as the developing roller 104 rotates.

The developing roller 104 supplies the toner 110 to the electrostatic latent image, thereby reverse-developing the electrostatic latent image. High voltages are applied to both the photoconductive drum 101 and the developing roller 104 by the respective power supplies (not shown), thereby creating an electric field is developed between the electrostatic latent image and the developing roller 104. As a result, the toner 110 on the developing roller 104 is attracted to the electrostatic latent image due to an electrostatic force. In this manner, the electrostatic latent image is developed with the toner 110 into a toner image. The aforementioned processes of charging, exposing, developing, and transferring are initiated at corresponding timings.

Referring back to FIG. 1, the top page of the stack of recording paper is advanced by transport rollers 45*a* and 45*b* on a page-by-page basis in a direction shown by arrow S. Then, the recording paper 50 is transported by the transport rollers 45*b*, 45*c*, 45*e*, and 45*f* in a direction shown by arrow E. The transport rollers 45*e* and 45*f* cooperate with each other to correct skew of the recording paper 50. The recording paper 50 is further advanced to the transfer belt 17, which is driven by the drive roller 18 to run in a direction shown by arrow F. The previously described electrophotographic processes are performed at predetermined timings during transportation of the recording paper 50 from the paper cassette 11 to the transfer belt 17.

Referring back to FIG. 3, the recording paper 50 is electrostatically attracted to the transfer belt 17, and is transported to a transfer point where the toner image is transferred from the photoconductive drum 101 onto the recording paper 50 by the transfer roller 20 to which the transfer bias is applied. The respective transfer rollers 20-23 receive bias voltages of +3.6 kV, +3.8 kV, +4.0 kV, and +4.3 kV, respectively.

The recording paper 50 advances through the print engines 31-34 as the transfer belt 17 runs in the F direction (FIG. 1), so that the black, yellow, magenta, and cyan toner images are transferred onto the recording paper 50 one over the other in registration.

After the toner images of the respective color have been transferred onto the recording paper 50, the recording paper 50 further advances in a direction shown by arrow H to the fixing unit 40. The fixing unit 40 includes a heat roller 141 and a pressure roller 142 in pressure contact with the heat roller 141. The pressure roller 142 and heat roller 141 rotate in directions shown by arrows J and I, respectively. The surface of the heat roller 141 is maintained to a predetermined temperature under control of a temperature controlling means (not shown). As the recording paper 50 is pulled in between the heat roller 141 and the pressure roller 142, the toner images on the recording paper 50 are fused into the recording paper 50 by heat and pressure.

Then, the recording paper 50 leaves the fixing unit 40, and is further transported by the transport rollers 45*g* and 45*h*, and then by the transport rollers 45*i* and 45*j* in a direction shown by arrow L to the outside of the printer 10.

A small amount of the toner 110 may have been left on the photoconductive drum 101 after transfer of a toner image. The cleaning blade 105 scrapes the remaining toner 110 from the photoconductive drum 101. The cleaning blade 105 is mounted to a rigid supporting member, and extends in a direction parallel to the rotational axis of the photoconductive drum 101 such that the cleaning blade 105 is in pressure contact with the photoconductive drum 101. As the photoconductive drum 101 rotates, the cleaning blade 105 cleans the surface of the photoconductive drum 101 before performing the next electrophotographic processes.

A small amount of the toner 110 that failed to be normally transferred onto the paper may be transferred onto the transfer belt 17. The residual toner on the transfer belt 17 is scraped by the cleaning blade 24 as the transfer belt 17 runs in the F and R directions. The scraped residual toner is then collected into the waste developer tank 25. In this manner, the transfer belt 17 is cleaned before the next image formation cycle.

When printing is performed in a duplex mode, the recording paper 50 is transported by the transport rollers 45*k* and 45*l* and transport rollers 45*w* and 45*x* in a direction shown by arrow M after having been printed on one side thereof, and is then switched back in a direction shown by arrow N. As a result, the recording paper 50 is flipped over. Then, the recording paper 50 is advanced by the transport rollers 45*m*-45*v* in directions shown by arrows O, P, and Q in sequence. Then, the recording paper 50 is transported by the transport rollers 45*c* and 45*d* in the E direction, so that the recording paper 50 is printed on its back surface on which no image has been printed yet.

{Manufacturing Toners}

The toner 110 will now be described. The toner 110 of the invention may be either a pulverized toner or a polymerized toner. The pulverized toner is manufactured as follows: A binder resin, a releasing agent, a colorant, a charge control agent, and a wax are melted together and then kneaded. The kneaded material is pulverized and then classified, thereby obtain a pulverized toner.

The polymerized toner is manufactured as follows:

A dispersing agent, a colorant, a charge control agent, and a wax are dispersed in a monomer which serves as a material for a binder resin. Then, the thus prepared dispersion liquid is placed in water as a dispersion medium, and then placed in, for example, a homogenizer, thereby obtaining oil drops, which are polymerized into toner particles due to polymerization reaction within the homogenizer.

The invention will be described in terms of the pulverized toner, though the polymerized toner may be used as well.

Synthetic resins commonly used for toner may be employed as a binder resin which serves as a base material for the toner 110. Synthetic resins include polyester resins, styrene acrylic resin, epoxy resins, and stylene-butadiene resins.

Releasing agents include copolymers, for example, low molecular weight polyethylene and olefin; and alphatic hydrocarbon waxes, for example, microcrystalline wax, paraffin wax, and Fisher-Tropsh wax; oxides of alphatic hydrocarbon waxes or block copolymers of alphatic hydrocarbon waxes; waxes, for example, carnauba wax, montanic acid ester wax whose base compositions are aliphatic ester; and aliphatic esters which are partially or totally deoxidized. The releasing agent is in an amount of 0.1-15 weight parts, preferably 0.5-12 weight parts, based on 100 weight parts of the binder resin 100. A mixture of a plurality of waxes may be conveniently used.

The colorants may be conventional dyes and pigments that are used as a colorant for black and colored toners. The colorants for the invention include carbon black, ferric oxide, phthalocyanine blue, permanent brown FG, brilliant first scarlet, pigment green B, rhodamine-B-base, solvent red 49, solvent red 146, pigment blue15:3, solvent blue 35, quinacridone, carmine 6B, and disazo yellow.

The following may be added, if necessary, to the toner 110: a charge control agent; a conductivity control agent; a loading pigment; a reinforcing filler such as a fibrous material; an antioxidant; an anti-aging agent; and a flowability agent.

The toner 110 is mixed with a fine inorganic powder for improving environmental stability, charge stability, developerbility, flowability, and storage stability of the toner 110. The inorganic powder is preferably a hydrophobic fine inorganic fine powder, and is externally added to toner particles. Fine inorganic powders include silica fine powder and hydrophobic materials.

The inventor investigated the reproducibility of a position-coding pattern printed on a sheet of paper for use with a digital pen. The inventor focused on the amount of charge on the toner particles, and has made the present invention. In other words, the inventors concluded that the reproducibility of a position-coding pattern may be improved if the amount of charge is larger for the toner used for printing the position-coding pattern than it is for the toners used for printing normal images other than the position-coding pattern.

Figure 6:
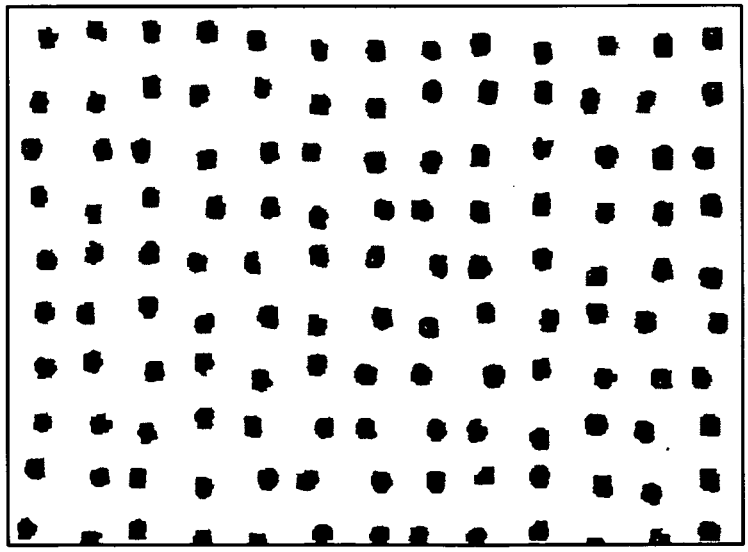
FIG. 6 illustrates an expanded view of the Anoto pattern printed using the patter-printing toner of the invention.

The position-coding pattern of the embodiment of the invention is a dot pattern under specific rules or according to predetermined specifications. One such position-coding pattern is the Anoto pattern that may be recognized by the Anoto pen. As shown in FIG. 6, the Anoto pattern is a dot pattern in which each dot is slightly away from grids of orthogonally crossing virtual lines, and slightly away from the crossing virtual lines. Thus, the position of each dot represents a position coordinate on the paper on which the Anoto patter is printed. The position-coding pattern of the invention is printed with black toner, which is referred to as "pattern-printing toner" in this specification. The position-coding pattern of the invention has a resolution equivalent to that of the Anoto pattern. Conversely, the toner for printing normal images is referred to as "image-printing toner" in this specification. It is to be noted that images are printed using yellow, magenta, and cyan toners and a composite black toner obtained by combining these colored toners.

Example #1

{Pattern-Printing Toner}

The following materials were mixed together in a HENSCHEL mixer: 100 weight parts polyester resin (number average molecular weight, Mn=3700, glass transition point Tg=62° C., softening point $T_{1/2}$=115° C.), 0.5 weight parts charge control agent (T-77 available from HODOGAYA CHEMICAL LTD.), 5 weight parts carbon black (MOGUL-L available from CABOT), and 4.0 weight parts carnauba (carnauba wax No. 1 powder, available from KATOYOKO). Carbon black serves an infrared ray absorbing agent, an additive for helping the Anoto pen read the position information printed on a sheet of paper, and a colorant. Then, the mixture was melted and kneaded with a twin screw extruder, was then cooled, and was finally crushed coarsely with a cutter mill having a 2-mm diameter screen. Then, the crushed material was pulverized with an impact jet pulverizer or a dispersion separator (available from Nihon Pneumatic Industry), and then classified using a pneumatic separator, thereby obtaining a base toner.

Subsequently, the base toner was subjected to an externally adding process. Hydrophobic silica (average primary particle diameter: 16 nm, available from Japan Aerosil) in an amount of 3.0 weight parts was added to 1 kg of the base toner (100 weight parts), and was agitated in a HENSCHEL mixer for 3 minutes, thereby obtaining a "pattern-printing toner" of the first embodiment.

Figure 4:
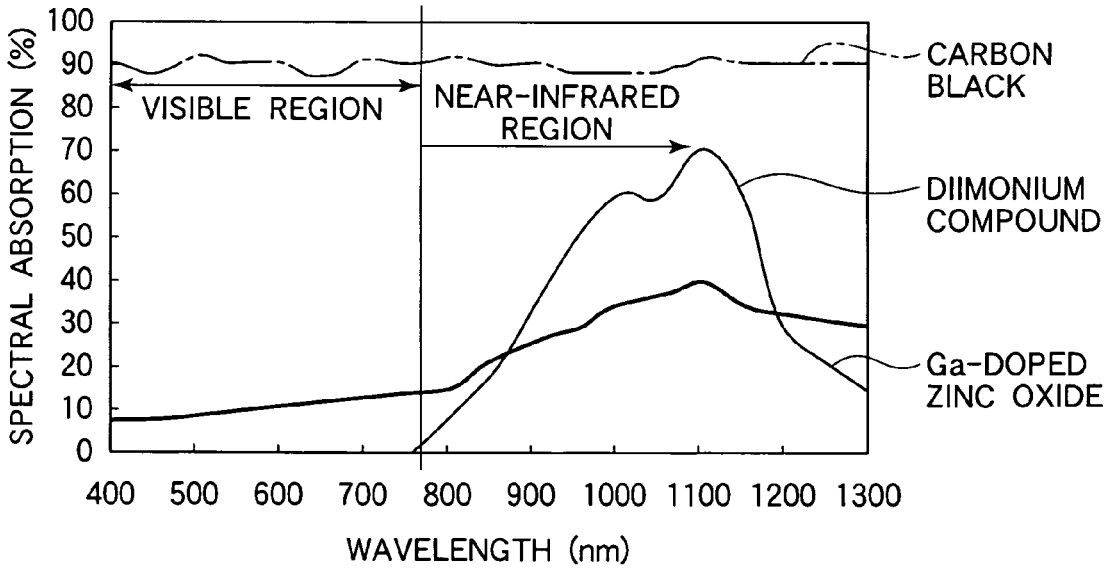
FIG. 4 illustrates the spectral absorption characteristics of the pattern-printing toner of the invention.

The volume mean particle diameter of the pattern-printing toner particles may be measured with a Coulter counter at a 100 μM aperture and 3000 counts. The thus measured volume mean particle diameter was 60 μm. FIG. 4 illustrates the spectral absorption characteristics of the pattern-printing toner of the invention. As is clear from FIG. 4, the pattern-printing toner exhibits a spectral absorption characteristic, originating from carbon black, in visible region and near-infrared region.

{Measurement of Charge Amount on Toner Particles}

A first amount of charge or the amount of charge on the pattern-printing toner particles deposited on the developing roller 104 is measured as follows: The LED head 103 illuminates the charged surface of the photoconductive drum 101 to form an electrostatic latent image. As the photoconductive drum 101 rotates, the electrostatic latent image approaches a developing point defined between the photoconductive drum 101 and the developing roller 104. At the developing point, the electrostatic latent image is developed with the toner into a toner image. The toner particles on the developing roller 104 were blown off the developing roller 104 using gaseous nitrogen. The amount of charge on the particles blown off was measured using an E-SPART analyzer (not shown). The following are measurement conditions.

Measuring apparatus: E-SPART analyzer Model EST-1 (available from HOSOKAWA MICRON).

Measurement Conditions
Field voltage: 100 V
Particle density: 1.00 g/cm$^3$
Frequency Shift (Hz)/Charge channel: 100
Max. total count: 1000
Size channel offset: 25
Charge channel offset 14499
PM voltage: 480 kV
Gas Blowing Conditions
Gas: nitrogen
Blowing pressure: 0.3 Mpa
Nozzle angle: 45 degrees
Nozzle distance: 5 mm from toner particles to be blown
Blow intervals: 0 sec. (i.e., continuous blowing)

A first average amount of charge of the pattern-printing toner or the measured average amount of charge of the pattern-printing toner deposited on the developing roller 104 was −20 μC/g. The coefficient of variation, which is given by coefficient of variation, σ/m, was 0.41. The coefficient of variation σ/m is the ratio of the standard deviation σ of the distribution of the amounts of charge on the toner particles to the average value m of amounts of charge on the toner particles.

{Preparation of Image-Printing Toners}

A magenta image-printing toner (M) was prepared in the same way as the pattern-printing toner except that 5 weight parts quinacridone was used in place of carbon black and 0.5 weight parts BONTRON E-84 were used as a charge control agent in place of T-77. A second average amount of charge or the average amount of charge of the image-printing toner (M) was measured. The average amount of charge, m, on the magenta image-printing toner (M) on the developing roller 104 was −13.0 μC/g. The coefficient of variation σ/m was 0.62.

A yellow image-printing toner (Y) was prepared in the same way as the magenta image-printing toner (M) except that 5 weight parts mono azo yellow was used in place of quinacridone. The average amount of charge, m, on the yellow image-printing toner (Y) on the developing roller 104 was −13.1 μC/g. The coefficient of variation σ/m was 0.61.

A cyan image-printing toner (C) was prepared in the same way as the magenta image-printing toner (M) except that 5 weight parts phthalocyanine blue was used in place of quinacridone. The average amount of charge, m, on the yellow image-printing toner (Y) deposited on the developing roller 104 was −12.9 μC/g. The coefficient of variation σ/m was 0.60.

Figure 5:
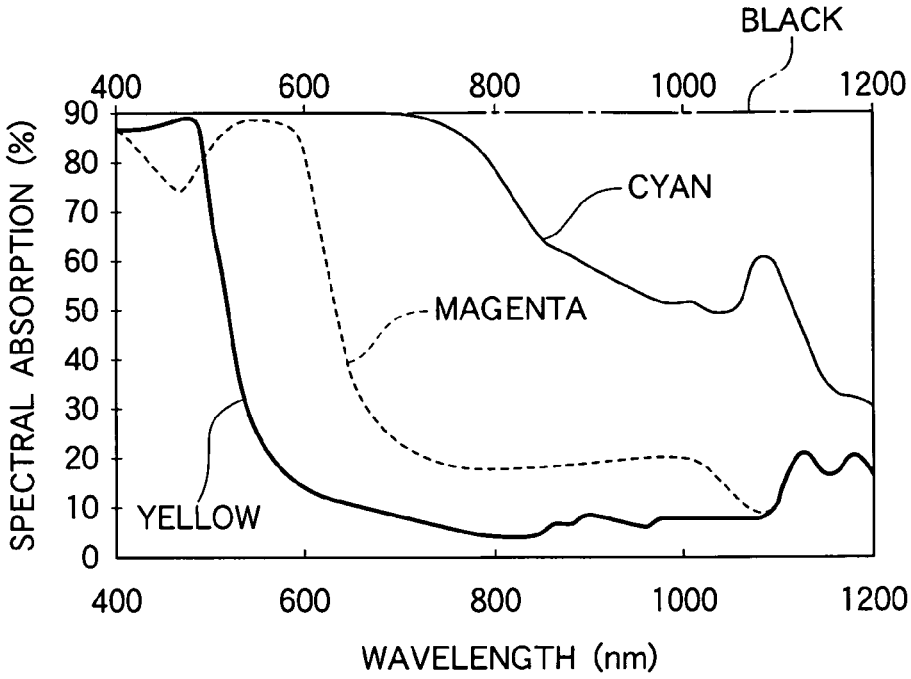
FIG. 5 illustrates the spectral absorption characteristics of magenta, yellow, and cyan toners.

FIG. 5 illustrates the spectral absorption characteristics of the magenta (M), yellow (Y), and cyan (C) toners. These toners each have a peak absorption at a wavelength in the range of 400 to 750 nm.

The black (K) as a pattern-printing toner, and yellow (Y), magenta (M), and cyan (C) toners as an image-printing toner were placed in the print engines 31, 32, 33, and 34, respectively. The print engines 31-34 were attached to the printer 10, being aligned along the transport path of the recording paper 50 as shown in FIG. 1. Then, printing was performed. The print engine 31 was operated to print an Anoto pattern on the recording paper 50. Then, the print engines 31-32 were operated to print an ISO/JIS-SCID N1 portrait image (JIS 9201-1995 (ISO/JIS-SCID)). A latent image of an ISO/JIS-SCID N1 portrait image was formed, developed with the pattern-printing toner, transferred onto the recording paper 50, and then fixed into a permanent image. The printed portrait was satisfactory, having sufficient graininess and color reproducibility.

Then, the contrast of the thus printed Anoto pattern was measured using the Anoto pen. Specifically, contrast was measured between the background (substantially white, non-printed portion) and the Anoto pattern by using an Anoto pattern analyzer (available from TECHKON). A minimum value which is an indication of recognition performance was 0.91, and the standard deviation representative of variations of the recognition performance was 0.0028. "Minimum value" refers to a lowest value of the contrast between printed dots and the background at which the Anoto pen may detect dots of an infrared absorbing material printed on the paper. The minimum value is dimensionless. The minimum value specified by Anoto Group of Lund, Sweden was 0.73. Thus, it can be concluded that the position-coding pattern printed using the pattern-printing toner of the invention was sufficient. FIG. 6 illustrates an expanded view (magnification: ×10) of the Anoto pattern printed using the patter-printing toner of the invention. As is clear from FIG. 6, observation under a magnifier showed that respective dots were very well-shaped. Table 1 correlates the average amount of charge on the toner particles of the pattern-printing toner with the reproducibility of the dot pattern. Table 2 correlates the average amount of charge on the toner particles of the yellow, magenta, and cyan image-printing toners (Y, M, and C) with their coefficients of variation σ/m.

Tables 1 and 2 reveal that the pattern-printing toner has smaller coefficients of variation σ/m than the image-printing toners. In other words, the distribution of the amount of charge for the pattern-printing toner (first distribution) has a smaller standard deviation than the distribution of the amount of charge for the pattern-printing toner (second distribution).

TABLE 1

| PARAMETERS | FIRST EMBODIMENT | | | SECOND EMBODIMENT | | | |
|---|---|---|---|---|---|---|---|
| | EX. 1 | CMP. 1 | CMP. 2 | EX. 2 | CMP. 3 | EX. 3 | CMP. 4 |
| ADDITIVE | CARBON BLK | CARBON BLK | CARBON BLK | ZINC OXIDE | ZINC OXIDE | DIIMONIUM based dye | DIIMONIUM based dye |
| CHRG CNTRL AGENT (WEIGHT PARTS) | 0.5 | 0.1 | 0.2 | 10 | 0.1 | 10 | 0.1 |
| AVRG CHRG (μC/g) | −20.0 | −10.1 | −13.0 | −19.1 | −10.5 | −18.9 | −10.4 |
| COEFF OF VARIATION | 0.41 | 1.11 | 0.61 | 0.44 | 1.19 | 0.39 | 1.16 |
| MIN CNTRST | 0.91 | 0.65 | 0.70 | 0.92 | 0.63 | 0.90 | 0.66 |
| STD DEV | .0028 | .0210 | .0102 | .0025 | .0222 | .0029 | .0200 |
| MIN VALUE | 0.73 | 0.73 | 0.73 | 0.73 | 0.73 | 0.73 | 0.73 |
| RESULTS | GOOD | NG | NG | GOOD | NG | GOOD | NG |

TABLE 2

| PARAMETERS | YELLOW | MAGENTA | CYAN |
|---|---|---|---|
| AVERAGE CHARGE AMOUNT (μC/g) | −13.1 | −13.0 | −12.9 |
| COEFFICIENT OF VARIATION, σ/m | 0.61 | 0.62 | 0.60 |

Comparison #1

A pattern-printing toner (COMPARISON #1) was prepared in the same way as EXAMPLE 1 except that 0.1 weight parts T-77 (charge control agent) was used. The average amount of charge on COMPARISON #1 deposited on the developing roller 104 was −10.1 μC/g. The coefficient of variation σ/m was 1.11. This implies that a decreased amount of charge control agent results in a lower average amount of charge and a fat-tailed distribution of the amount of charge on the toner particles, i.e., the amounts of charge are spread out over a large range of values. The pattern-printing toner of COMPARISON #1 and the colored toners (Y, M, C) of EXAMPLE #1 were placed in the print engines 31-34, respectively, and the print engines 31-34 were attached to the printer 10. Printing was performed just as in EXAMPLE #1. The print engine 31 was operated to print an Anoto pattern on the recording paper 50. Then, the print engines 31-32 were operated to print an ISO/JIS-SCID N1 portrait image NIS 9201-1995 (ISO/JIS-SCID)). The printed portrait was satisfactory, having sufficient graininess and color reproducibility.

Figure 7:
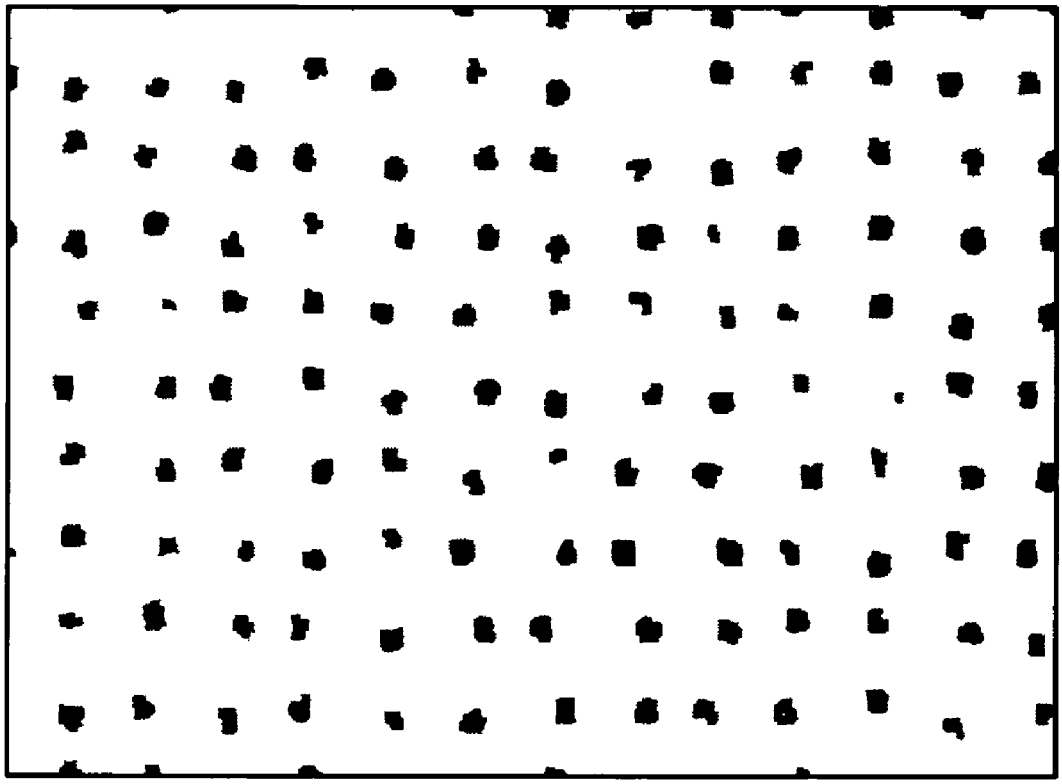
FIG. 7 illustrates an expanded view of the Anoto pattern printed using the pattern-printing toner of COMPARISON #1.

Then, the contrast of the thus printed Anoto pattern was measured using the Anoto pen. A minimum value which is an indication of recognition performance was 0.65, and the standard deviation, which represents variations of the recognition performance, was 0.0210. The minimum value was slightly below 0.73 specified by Anoto Group of Lund. Thus, it can be concluded that the position-coding pattern printed using COMPARISON #1 was insufficient. FIG. 7 illustrates an expanded view (×10) of the Anoto pattern printed using the patter printing toner of COMPARISON #1. Referring to FIG. 7, dots in some areas were missing and dust of toner was noticed in the vicinity of dots. Table 1 correlates the average amount of charge on the toner particles of COMPARISON #1 with the reproducibility of the position-coding pattern.

Comparison #2

A pattern-printing toner (COMPARISON #2) was prepared in the same way as EXAMPLE 1 except that 0.2 weight parts T-77 (charge control agent) was used. The average amount of charge on COMPARISON #2 deposited on the developing roller 104 was −13.0 μC/g. The coefficient of variation σ/m was 0.61. This implies that decreasing the amount of a charge control agent results in a lower average amount of charge and a fat-tailed distribution of the amounts of charge on the toner particles, i.e., the amounts of charge are spread out over a large range of values. The colored toners (Y, M, C) of EXAMPLE #1 and the pattern-printing toner of COMPARISON #1 were placed in the print engines 31-34, respectively, and the print engines 31-34 were attached to the printer 10. Printing was performed just as in EXAMPLE #1. The print engine 31 was operated to print an Anoto pattern on the recording paper 50. Then, the print engines 31-32 were operated to print an ISO/JIS-SCID N1 portrait image (JIS 9201-1995 (ISO/JIS-SCID)). The printed portrait was satisfactory, having sufficient graininess and color reproducibility.

Then, the contrast of the thus printed Anoto pattern was measured using the Anoto pen. A minimum value which is an indication of recognition performance was 0.70, and the standard deviation representative of variations of the recognition performance was 0.0102. The minimum value was slightly below 0.73 specified by Anoto Group of Lund. Thus, it can be concluded that the printed pattern using COMPARISON #2 was insufficient. Dots in some areas were missing and dust of toner was noticed in the vicinity of dots. Table 1 correlates the average amount of charge on the toner particles of COMPARISON #2 with the reproducibility of the position-coding pattern.

The image-printing toners (Y, M, and C) are used to print, for example, figures, tables, and characters. Thus, a relatively large amount of these toners needs to be deposited to the photoconductive drum 101. In contrast, the pattern-printing toner simply needs to print a position-coding pattern or a pattern of dots having a diameter of only about 100 μm. Printing such a position-coding pattern requires a relatively small amount of toner to be deposited on the photoconductive drum 101.

It is to be noted that the toner on the photoconductive drum 101 is transferred onto the recording paper 50 by the Coulomb force developed by the electric field across the photoconductive drum and the transfer roller. In order to improve the reproducibility of the dot positions, it is necessary to increase the amount of charge on the toner particles so that the toner particles will be transferred onto the positions on the photoconductive drum where they should be. If the amount of charge on the toner particles is large, the image force acting between the photoconductive drum 101 and the toner particles is large. If a large amount of toner is deposited to the photoconductive drum 101, the image force is large, making it difficult for the toner particles close to the surface of the photoconductive drum 101 to leave the photoconductive drum 101. As a result, the amount of residual toner on the photoconductive drum 101 increases, failing to ensure sufficient density of an image printed on the recording paper 50. In addition, it becomes difficult for the cleaning blade 105 to scrape the residual toner from the photoconductive drum 101. The increased amount of residual toner may pass through under the cleaning blade 105, resulting in poor cleaning effect.

As described previously, printing a position-coding pattern consumes only a limited amount of toner and therefore the amount of residual toner is small, being free from the aforementioned drawbacks. In contrast, printing normal images consumes a larger amount of toners and therefore poor cleaning may occur.

For the reasons mentioned above, it is preferable that the average amount of charge on the toner particles is smaller for the image-printing toner than for the pattern-printing toner.

One way of increasing the amount of charge on the toner particles is to increase the amount of the charge control agent. One way of ensuring a slim-tailed distribution of the amount of charge on the toner particles is to employ a charge control agent having a smaller particle diameter, to employ a toner having a slim-tailed distribution of toner particle diameter, or to employ a toner having a slim-tailed distribution of granularity.

A charge control agent having a smaller particle diameter and toners having a slim-tailed distribution of toner particle diameter increase the production costs of toner. Moreover, a slim-tailed distribution of the amounts of charge on the toner particles leads to increased production costs both in the pattern-printing toner and the image-printing toners. Thus, it is preferable that the amounts of charge on the toner particles are larger for the image-printing toner than for the pattern-printing toner.

As described above, the pattern-printing toner has a larger amount of charge than the image-printing toners, and has a distribution of the amount of charge on the toner particles having a smaller standard deviation than the image-printing toners do. Thus, the pattern-printing toner of the first embodiment is sufficient to form a position-coding pattern that enables the Anoto pen to capture information on its position on the position-coding pattern, and improves the dot recognition performance.

Second Embodiment

The first embodiment has been described in terms of a toner that employs carbon black. The carbon black serves as a colorant and an infrared ray absorbing agent that absorbs light in the near infrared region recognized by the Anoto pen. A second embodiment differs from the first embodiment in that an infrared ray absorbing agent other than carbon black is used.

Example #2

{Pattern-Printing Toner}

The following materials were mixed together in a HENSCHEL mixer: 100 weight parts polyester resin (number average molecular weight, Mn=3700, glass transition point Tg=62° C., softening point $T_{1/2}$=115° C.), 0.5 weight parts charge control agent (T-77 available from HODOGAYA CHEMICAL LTD.), 10 weight gallium-doped zinc oxide (Pazet GK-40, available from HakusuiTech), and 4.0 weight parts carnauba. (carnauba wax No. 1 powder, available from KATOYOKO). Gallium-doped zinc oxide serves as an infrared ray absorbing agent, an additive for helping the Anoto pen read the position information, and a colorant. Then, the mixture was melted and kneaded with a twin screw extruder, was then cooled, and was finally crushed coarsely with a cutter mill having a 2-mm diameter screen. Then, the crushed material was pulverized with an impact jet pulverizer or a dispersion separator (available from Nihon Pneumatic Industry), and then classified using a pneumatic separator, thereby obtaining a base toner.

Subsequently, the base toner was subjected to an externally adding process. Hydrophobic silica (average primary particle diameter: 16 nm, available from Japan Aerosil) in an amount of 3.0 weight parts was added to 1 kg of the base toner (100 weight parts), and was agitated in a HENSCHEL mixer for 3 minutes, thereby obtaining a pattern-printing toner (EXAMPLE #2) of the second embodiment.

The average amount of charge on the pattern-printing toner deposited on the developing roller 104 was −19.1 μC/g. The coefficient of variation σ/m was 0.44.

Because gallium-doped zinc oxide (GZO) is a substantially white powder under visible light, a toner incorporating gallium-doped zinc oxide is invisible (substantially the same as the color of the recording paper 50) to human eyes when illuminated by visible light. Thus, unlike an image printed using the toner incorporating carbon black, an image printed incorporating the gallium-doped zinc oxide looks substantially white, which is the same as, for example, the recording paper 50. Referring to FIG. 4, the pattern-printing toner incorporating gallium-doped zinc oxide does not absorb visible light and has a peak absorption at a wavelength (800-1200 nm) in the near infrared region.

The pattern-printing toner of the second embodiment and the image-printing toners (Y, M, C) of EXAMPLE #1 were placed in the print engines 31-34, respectively, and the print engines 31-34 were attached to the printer 10. Printing was performed just as in EXAMPLE #1. The print engine 31 was operated to print an Anoto pattern on the recording paper 50. Then, the print engines 31-32 were operated to print an ISO/JIS-SCID N1 portrait image (JIS 9201-1995 (ISO/JIS-SCID)). The printed portrait was satisfactory, having sufficient graininess and color reproducibility.

Then, the contrast of the thus printed Anoto pattern was measured using the Anoto pen. A minimum value which is an indication of recognition performance was 0.92, and the standard deviation representative of variations of the recognition performance was 0.0025. The minimum value specified by Anoto Group of Lund was 0.73. Thus, it can be concluded that the position-coding pattern printed using the pattern-printing toner of the invention was sufficient. Observation under a magnifier showed that the respective dots were very well-shaped. Table 1 correlates the average amount of charge on the toner particles of EXAMPLE #2 with the reproducibility of the dot pattern.

The pattern-printing toner (EXAMPLE #2) of the second embodiment incorporates gallium-doped zinc oxide instead of carbon black. Non-printed areas of the recording paper 50 are substantially white and has no gray hue which would otherwise be if EXAMPLE #1 is used, allowing the printed image to look nice and attractive.

Comparison #3

A pattern-printing toner (COMPARISON #3) was prepared in the same way as EXAMPLE 2 except that 0.1 weight parts T-77 (charge control agent) was used. The average amount of charge on COMPARISON #3 deposited on the developing roller 104 was −10.5 μC/g. The coefficient of variation σ/m was 1.19. This implies that decreasing the amount of a charge control agent results in a lower average amount of charge on the toner particles and a fat-tailed distribution of the amounts of charge on the toner particles, i.e., the amounts of charge are spread out over a large range of values.

COMPARISON #3 and the colored toners (Y, M, C) of EXAMPLE #1 were placed in the print engines 31-34, respectively, and the print engines 31-34 were attached to the printer 10. Printing was performed just as in EXAMPLE #1. The print engine 31 was operated to print an Anoto pattern on the recording paper 50. Then, the print engines 31-32 were operated to print an ISO/JIS-SCID N1 portrait image (JIS 9201-1995 (ISO/JIS-SCID)). The printed portrait was satisfactory, having sufficient graininess and color reproducibility.

Then, the contrast of the thus printed Anoto pattern was measured using the Anoto pen. A minimum value which is an indication of recognition performance was 0.63, and the standard deviation representative of variations of the recognition performance was 0.0222. Thus, the minimum value of the recognition performance was slightly below 0.73 specified by Anoto Group of Lund. Thus, it can be concluded that the printed pattern using the pattern-printing toner of the invention was insufficient. Dots in some areas were missing and the dust of toner was noticed in the vicinity of dots. Table 1 correlates the average amount of charge on the toner particles of COMPARISON #3 with the reproducibility of the dot pattern.

Example #3

The following materials were mixed together in a HENSCHEL mixer: 100 weight pars polyester resin (number average molecular weight, Mn=3700, glass transition point Tg=62° C., softening point $T_{112}$=115° C.) 0.5 weight parts charge control agent (T-77 available from HODOGAYA CHEMICAL LTD.), 10 weight KAYASORB-IRG022 (a diimonium-based dye manufactured by Nippon Kayaku Co., Ltd. of Tokyo, Japan, and 4.0 weight parts carnauba (carnauba wax No. 1 powder, available from KATOYOKO) as a release agent. KAYASORB-IRG022 serves as an organic infrared absorbing agent, an additive for helping the Anoto pen read the position information, and a colorant. Diimonium is an infrared absorbing material often used in optical recording media such as CDs and DVDs. Then, the mixture was melted and kneaded with a twin screw extruder, was then cooled, and was finally crushed coarsely with a cutter mill having a 2-mm diameter screen. Then, the crushed material was pulverized with an impact jet pulverizer or a dispersion separator (available from Nihon Pneumatic Industry), and then classified using a pneumatic separator, thereby obtaining a base toner.

Subsequently, the base toner was subjected to an externally adding process. Hydrophobic silica (average primary particle diameter: 16 nm, available from Japan Aerosil) in an amount of 3.0 weight parts was added to 1 kg of the base toner (100 weight parts), and was agitated in a HENSCHEL mixer for 3 minutes, thereby obtaining the pattern-printing toner of EXAMPLE #3.

The average amount of charge on EXAMPLE #3 deposited on the developing roller 104 was −18.9 μC/g. The coefficient of variation σ/m was 0.39.

KAYASORB-IRG022 is a green powder under visible light. Because only a small amount of KAYASORB-IRG022 is incorporated, the resulting toner is rather invisible (substantially the same color, i.e., white, as the recording paper 50) to human eyes when illuminated by visible light. Thus, unlike an image printed using the toner incorporating carbon black (EXAMPLE #1), an image printed using EXAMPLE #3 incorporating KAYASORB-IRG022 looks substantially white, which is the same as, for example, the recording paper 50. Referring to FIG. 4, the pattern-printing toner incorporating KAYASORB-IRG022 does not absorb visible light and has a peak absorption at a wavelength (800-1200 nm) in the near infrared region.

The EXAMPLE #3 of the second embodiment and the image-printing toners (Y, M, C) of EXAMPLE #1 were placed in the print engines 31-34, respectively, and the print engines 31-34 were attached to the printer 10. Printing was performed just as in EXAMPLE #1. The print engine 31 was operated to print an Anoto pattern on the recording paper 50. Then, the print engines 31-32 were operated to print an ISO/JIS-SCID N1 portrait image (JIS 9201-1995 (ISO/JIS-SCID)). The printed portrait was satisfactory, having sufficient graininess and color reproducibility.

Then, the contrast of the thus printed Anoto pattern was measured using the Anoto pen. A minimum value which is an indication of recognition performance was 0.90, and the standard deviation representative of variations of the recognition performance was 0.0029. The minimum value of the recognition performance specified by Anoto Group of Lund is 0.73. Thus, it can be concluded that the printed patter using EXAMPLE #3 was sufficient. Observation under a magnifier showed that the respective dots were very well-shaped.

The pattern-printing toner of the second embodiment incorporates a substantially white pigment instead of carbon black. Non-printed areas of the recording paper 50 are substantially white, and have no gray hue which would otherwise be if EXAMPLE #1 is used. Table 1 correlates the average amount of charge on EXAMPLE #3 with the reproducibility of the dot pattern.

Comparison #4

A pattern-printing toner (COMPARISON #4) was prepared in the same way as EXAMPLE 3 except that 0.1 weight parts T-77 (charge control agent) was used. The average amount of charge on the pattern-printing toner particles on the developing roller 104 was −10.4 μC/g. The coefficient of variation σ/m was 1.16. This implies that decreasing the amount of the charge control agent results in a lower average amount of charge on the toner particles and a fat-tailed distribution of the amounts of charge on the toner particles, i.e., the amounts of charge are spread out over a large range of values. COMPARISON #4 and the colored toners (Y, M, C) of EXAMPLE #1 were placed in the print engines 31-34, respectively, and the print engines 31-34 were attached to the printer 10. Printing was performed just as in EXAMPLE #1. The print engine 31 was operated to print an Anoto pattern on the recording paper 50. Then, the print engines 31-32 were operated to print an ISO/JIS-SCID N1 portrait image (JIS 9201-1995 (ISO/JIS-SCID)). The printed portrait was satisfactory, having sufficient graininess and color reproducibility.

Then, the contrast of the thus printed Anoto was measured using the Anoto pen. A minimum value which is an indication of recognition performance was 0.66, and the standard deviation representative of variations of the recognition performance was 0.0200. The minimum value was slightly below 0.73 specified by Anoto Group of Lund. Thus, it can be concluded that the printed pattern using COMPARISON #4 was insufficient. Dots in some areas were missing and the dust of toner was noticed in the vicinity of dots. Table 1 correlates the amount of charge on COMPARISON #4 with the reproducibility of the dot pattern.

As described above, even when a pattern-printing toner incorporating an infrared ray absorbing agent that has a peak absorption (800-1200 nm) only in the near infrared region and no absorption in the visible light region, the absolute value of the amount of charge on the pattern-printing toner particles is larger than that of the image-printing toner and has a slim-tailed distribution of the amounts of charge on the toner particles. Thus, the second embodiment provides an image forming apparatus capable of printing a position-coding pattern which can be accurately recognized by the Anoto pen. The pattern-printing toner of the second embodiment does not absorb light in the visible light region. In other words, the position-coding pattern printed on the recording paper 50 is substantially white or is invisible to human eyes, thus providing a nice and attractive print so that a viewer may perceive the printed image without significant toner fog or background shading.

The present invention is not limited to the first and second embodiments and may be modified in any manner without departing the scope of the invention. While image forming apparatus of the embodiments has been described with respect to a printer, the present invention may also be applicable to a copying machine, a facsimile machine, or multi function printer (MFP).

What is claimed is:

1. An image forming apparatus, comprising:

a first print engine that prints a position-coding pattern, said first print engine holding a first developer material therein;

a plurality of second print engines each of which prints a corresponding image in accordance with print data, the image being different from the position-coding pattern, each of the second print engines holding a corresponding second developer material therein;

the first developer material is charged to a first average amount of charge and has a first distribution of amount of charge, and the second developer material is charged to a second average amount of charge and has a second distribution of amount of charge, such that the first average amount of charge is larger than the second average amount of charge, and that the first distribution of amount of charge has a smaller standard deviation than the second distribution of amount of charge.

2. The image forming apparatus according to claim 1, wherein the first developer material is white.

3. The image forming apparatus according to claim 1, wherein the first developer material has a peak absorption at a wavelength in infrared region.

4. The image forming apparatus according to claim 1, wherein the first developer material has a peak absorption at a wavelength in the range of 800-1200 nm.

5. The image forming apparatus according to claim 1, wherein the first developer material is black.

6. The image forming apparatus according to claim 1, wherein the first developer material contains carbon black therein.

7. The image forming apparatus according to claim 1, wherein the second developer material has a peak absorption at a wavelength in the range of visible light.

8. The image forming apparatus according to claim 1, wherein the first developer material has a peak absorption at a wavelength in the range of 400-750 nm.

9. The image forming apparatus according to claim 1, wherein the first print engine and said second print engines are aligned in a transport path in which a recording medium is transported.

10. The image forming apparatus according to claim 9, wherein the first print engine is disposed upstream of said second print engines with respect to a direction in which the recording medium is transported.

11. The image forming apparatus according to claim 1, wherein the position-coding pattern is a dot pattern formed of a plurality of dots such that each dot is separated from all the other dots.

12. The image forming apparatus according to claim 11, wherein the plurality of dots are positioned either on row lines or on column lines that cross the row lines except positions at which the row lines cross the column lines.

13. The image forming apparatus according to claim 1, wherein the position-coding pattern is an Anoto pattern.

14. The image forming apparatus according to claim 1, wherein said first print engine is a single print engine and the said second print engines include a yellow print engine that prints a yellow image, a magenta print engine that prints a magenta image, and a cyan print engine that prints a cyan image.

15. The image forming apparatus according to claim 1, wherein said first print engine prints a dot pattern with dot separated from one another, and said second print engines print at least either characters or an image other than characters and the position-coding pattern.

* * * * *